United States Patent [19]

Anthony et al.

[11] 4,366,604

[45] Jan. 4, 1983

[54] ANTI-CREEP SEAT BELT DEVICE WITH EMERGENCY RELEASE MEANS

[75] Inventors: James R. Anthony, Indianapolis; James W. Crooks, Carmel, both of Ind.

[73] Assignee: Indiana Mills & Mfg., Inc., Carmel, Ind.

[21] Appl. No.: 202,317

[22] Filed: Oct. 30, 1980

[51] Int. Cl.[3] ..... A44B 11/25

[52] U.S. Cl. ..... 24/230 A

[58] Field of Search ..... 24/171, 196, 230 R, 24/230 A, 230 AL

[56] References Cited

U.S. PATENT DOCUMENTS

| | | | |
|---|---|---|---|
| 2,919,481 | 1/1960 | Finken et al. | 24/196 |
| 3,393,433 | 7/1968 | Barcus | 24/230 A |
| 3,576,056 | 4/1971 | Barcus | 24/230 A X |

*Primary Examiner*—Robert P. Swiatek

*Attorney, Agent, or Firm*—Woodard, Weikart, Emhardt & Naughton

[57] ABSTRACT

A seat belt device including a buckle receiving an apertured tongue. A cover is pivotally mounted to the buckle frame and is engageable with a pawl to pivot the pawl to and from an apertured tongue releaseably secured within the buckle. An emergency release bar attached to the pawl extends rearwardly beneath the cover and is pivotable to force the pawl away from the frame releasing the apertured tongue. A roller bar on the buckle frame and/or the apertured tongue is slidable within a pair of slots at one end of which is located a seat belt stop. A second pair of side slots opens into the main slots releaseably holding the roller bar in a position to secure the seat belt against the stop preventing relative motion therebetween.

13 Claims, 8 Drawing Figures

ANTI-CREEP SEAT BELT DEVICE WITH EMERGENCY RELEASE MEANS

BACKGROUND OF THE INVENTION

This invention is in the field of seat belt buckles and particularly those seat belt devices which include means for preventing slippage of the seat belt with the device and further an emergency release mechanism to be utilized in the event the prime release means is damaged.

In U.S. Pat. No. 4,184,234 commonly owned by the assignee of the invention disclosed herein, there is disclosed a device releasably holding a seat belt against a stop surface buckle. The device includes a spring for forcing a roller bar to a position whereat the seat belt extending around the roller bar contacts a stop surface extending across the width of the belt.

Certain performance specifications require a seat belt buckle to undergo a 2,500 cycle test wherein force is repeatedly applied between the seat belt and buckle or tongue. Such tests may shorten the life of the seat belt particularly where abrasive force is applied to the belt by a stop surface on the tongue or buckle engaged with the belt. Disclosed herein is a new and improved anti-creep mechanism for limiting relative motion between the belt and tongue or buckle while minimizing abrasion between the belt and tongue or buckle.

Certain seat belt buckles utilize a pivotable cover to release the buckle from the associated tongue. It is possible to damage or completely destroy such covers, particularly when the buckle is utilized with large earth-moving vehicles. Disclosed herein is an emergency release mechanism in addition to the pivotable cover with both being operable to release the buckle from the associated tongue.

SUMMARY OF THE INVENTION

One embodiment of the present invention is a seat belt device comprising a roller bar with opposite end portions, a seat belt extending at least partially around the bar, a frame with a pair of main slots receiving the opposite end portions mounting the bar to the frame, the frame having a seat belt stop extending parallel to the bar, each slot having opposite ends with the bar being movable therebetween, the ends being positioned to allow the bar to move the belt to and from the seat belt stop, the slots being enlarged at a location forming lock seats to releaseably hold and receive the opposite end portions of the bar, the belt stop being positioned relative to the location to contact the belt limiting relative motion between the belt and the frame when the opposite end portions are in the lock seats.

Yet another embodiment of the present invention is a seat belt buckle comprising a main frame attachable to a belt, a cover pivotally mounted at one end of the frame and movable to and from a locked position and an unlocked position, a pawl pivotally mounted to the frame at the one end and pivotable to and from the frame forming a space therebetween to receive an aperture tongue plate to be releasably secured, spring means operable to normally urge the pawl toward the frame to secure the tongue but yieldable to allow movement of the pawl from the frame to release the tongue, the spring means also operable to urge the cover to the locked position but yieldable to allow the cover to pivot to the unlocked position, the cover contacting the pawl when the cover is pivoted to the unlocked position while pivoting the pawl away from the frame releasing the tongue, the pawl includes emergency release means operable to pivot the pawl away from the frame to release the tongue independent of the cover.

It is an object of the present invention to provide a new and improved seat belt device.

A further object of the present invention is to provide a seat belt device limiting relative motion between the device and a seat belt while minimizing abrasion between the device and belt.

Yet another object of the present invention is to provide emergency release means for a seat belt buckle.

Related objects and advantages of the present invention will be apparent from the following description.

DESCRIPTION OF THE PREFERRED EMBODIMENTS

Figure 1:
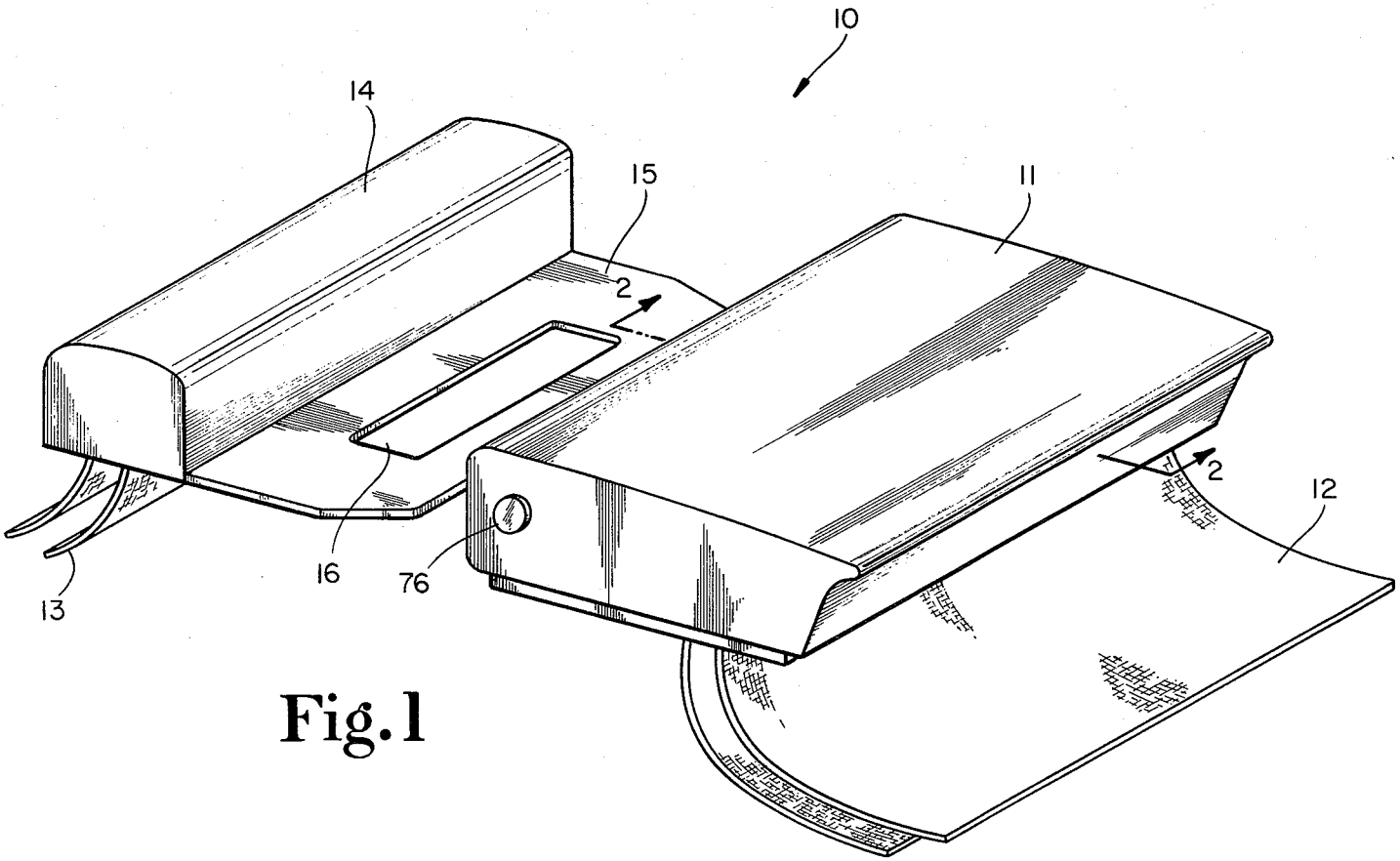
FIG. 1 is a perspective view of a seat belt buckle and tongue combination incorporating the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now more particularly to FIG. 1, there is shown a seat belt combination 10 including buckle 11 having a seat belt 12 slidably attached thereto. A second seat belt 13 is slidably attached to a tongue 14 which is slidably and releasably held and received by buckle 11. Tongue 14 includes a cantileveredly mounted plate 15 with an aperture 16 extending therethrough to receive a pivotally mounted pawl within buckle 11.

Buckle 11 includes a main frame 17 having a cover 18 pivotally mounted thereto and enclosing a cylindrical roller bar 19 slidably mounted to frame 17 with belt 12 extending around the roller bar. A pawl 20 is pivotally mounted to rod 21 secured to frame 17 with pawl 20 including at least one downwardly extending projection 22 engageable with aperture 16 of plate 15. A coiled spring 23 wrappingly mounted to rod 21 is operable to urge pawl 20 downwardly against frame 17. A second spring 24 wrappingly mounted to rod 21 is operable to force cover 18 to the downward position shown in FIG. 2. An emergency release bar 25 is integrally attached to pawl 20 and extends rearwardly beneath cover 18 and is operable to unlock the pawl relative to tongue 14 independently of cover 18.

Figure 4:
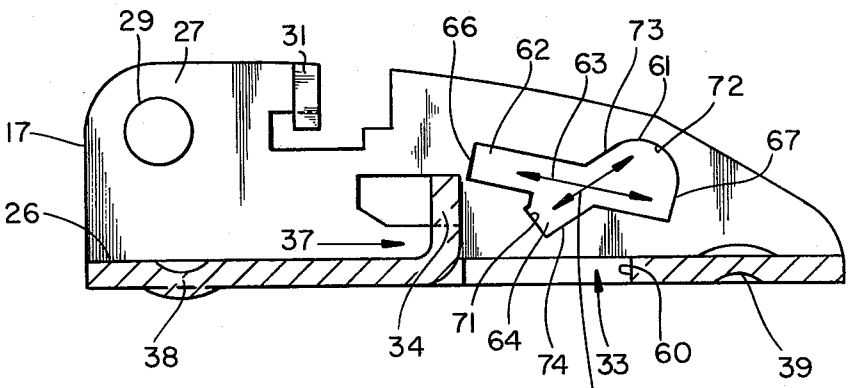
FIG. 4 is an enlarged cross-sectional view taken along the line 4—4 in FIG. 3 and viewed in the direction of the arrows.
Figure 3:
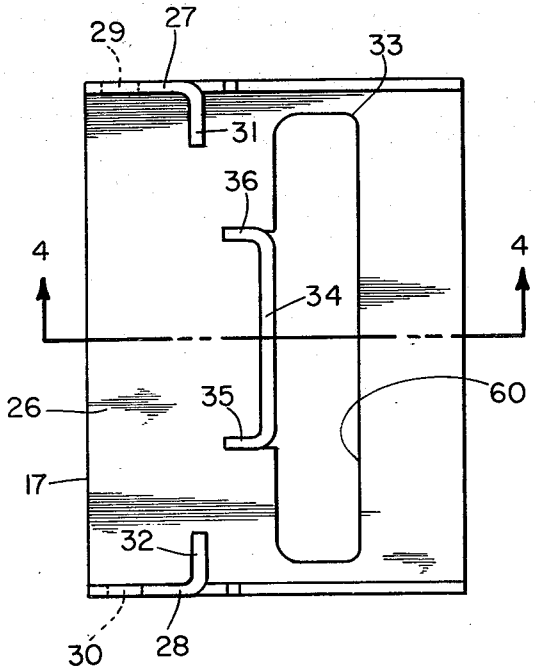
FIG. 3 is a top view of the frame of the buckle with the normally attached parts removed.

Main frame 17 (FIG. 3) includes a bottom wall 26 integrally attached along its opposite longitudinally extending edges to a pair of upwardly extending side walls 27 and 28 respectively having a pair of aligned holes 29 and 30 mountingly receiving the opposite ends of rod 21. A portion of side walls 27 and 28 extends inwardly forming a pair of ears 31 and 32 whose purpose will be described later in this specification. A slot 33 is provided in bottom wall 26 allowing belt 12 to extend therethrough and around roller bar 19. A somewhat similar buckle frame is disclosed in U.S. Pat. No. 2,846,745 issued to William Martin Lathrop, although the slots in the side wall of the Lathrop main frame are substantially different from the slots receiving the roller bar as shown in FIG. 4. Extending upwardly from bottom wall 26 adjacent the edge of slot 33 is upstanding wall 34 having a pair of parallel forwardly extending ears 35 and 36 spaced apart from bottom wall 26 forming a tongue-receiving slot 37 (FIG. 4). Thus, when plate 15 of the tongue is inserted completely into the buckle, the tongue will extend into slot 37 with ears 35 and 36 cooperatively with wall 26 limiting vertical movement of the tongue. Also shown in FIG. 4 is a pair of optional strengthening ribs 38 and 39 provided in bottom wall 26.

Figure 8:
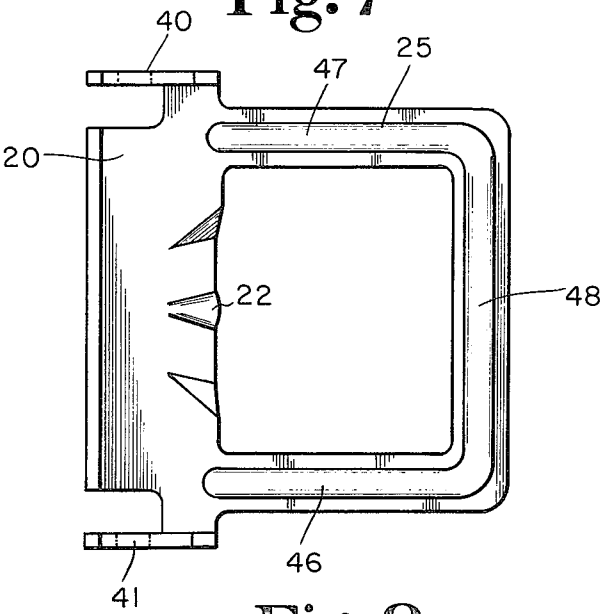
FIG. 8 is a top view of the pawl with emergency release means mountable to the frame of FIGS. 3 and 4.

Pawl 20 (FIG. 2) extends across the bottom wall 26 of the main frame and is positioned between side walls 27 and 28. Pawl 20 includes a pair of upstanding flanges 40 and 41 (FIG. 8) positioned immediately inward and adjacent respectively walls 27 and 28. Flanges 40 and 41 include a pair of holes aligned with holes 29 and 30 through which rod 21 (FIG. 2) extends. Pawl 20 is pivotable about an axis extending centrally through rod 21. A plurality of downwardly extending projections 22 are sized to fit into aperture 16 of the tongue plate when the plate is fully inserted into the buckle. The pawl is pivoted to the unlocked position when cover 18 (FIG. 2) is pivoted in the direction of arrow 42 about rod 21 forcing the downwardly extending edge 43 of the cover to contact the upward-turned lip 44 of the pawl. Normally, edge 43 is spaced apart from lip 44 allowing free pivotal travel of the cover in the direction of arrow 42 until the edge contacts lip 44 and forces the pawl to pivot in the direction of arrow 42 to the unlocked position.

Flanges 40 and 41 are both provided with an upwardly facing stop surface 45 (FIG. 2) contactable against the bottom surface of ears 31 and 32 (FIG. 3) limiting the upward pivotal travel of the pawl. A single helical spring 23 is wrappingly mounted to rod 21 with one end of the spring contacting the top surface of pawl 20 and with the opposite end of the spring contacting the bottom surface of one of the ears 31 and 32 thereby urging the pawl in a pivotal direction around rod 21 opposite to arrow 42 with the spring being yieldable to allow the pawl to pivot in the direction of arrow 42 when contacted by cover 18.

The emergency release means 25 (FIG. 8) includes a pair of arms 46 and 47 integrally attached to the pawl and extending rearwardly being integrally joined together by a cross member 48. Arms 46 and 47 extend over roller bar 19 (FIG. 2) immediately beneath the cover. The rear edge 49 (FIG. 2) of the cover extends forwardly forming a lip and is arranged to contact cross member 48 simultaneously with the contacting of edge 43 against lip 44 thereby cooperatively forcing the pawl to the unlocked position as the cover is pivoted in the direction of arrow 42 about rod 21. In the event cover 18 is damaged or destroyed, then the user may grasp cross member 48 to pivot the pawl in the direction of arrow 42. It will be noted that edge 49 of the cover is spaced apart from cross member 48 a sufficient distance to allow free travel of the cover as it is pivoted in the direction of arrow 42 until the edge contacts the cross member. As shown in FIG. 1, cover 11 includes downwardly extending side walls located outwardly of and adjacent side walls 27 and 28 of frame 17. Rod 21 (FIG. 2) extends through the upstanding flanges 40 and 41 of the pawl and through the side walls 27 and 28 of the frame. Conventional fastening devices such as rivets 76 (FIG. 1) extend through the side walls of the cover and into rod 21 securing the cover to the frame and allowing the cover to be pivoted.

Cover 18 is normally held in the downward position by helical spring 24 (FIG. 2) wrappingly mounted to rod 21. Spring 24 has one end extending through a downwardly extending projection 50 integrally attached to the cover. The opposite end 51 of spring 24 rests against the upwardly turned lip 44 of the pawl thereby urging the cover in a direction opposite of arrow 42 but yieldable to allow the cover and pawl to pivot in the direction of arrow 42.

The anti-creep device for limiting relative motion between belt 12 and the frame of the buckle is achieved by the mounting of the roller bar within particularly configured slots in cooperation with a widthwise extending stop edge 60 (FIG. 2) contactable against the belt. Each side wall 27 and 28 includes a generally X-configured slot 61 (FIG. 4) which receives the flattened opposite end portions of roller bar 19.

Slot 61 provided in side wall 27 will now be described, it being understood that an identical description applies to the X-configured slot provided in side wall 28. Slot 61 includes a main slot 62 extending in the direction of arrows 63 and a side slot 64 extending in the direction of arrows 65 and arranged relative to slot 62 in a general "X" configuration. Stop surface 60 extends across slot 33 (FIG. 3) with roller bar 19 being movable between the opposite ends 66 and 67 of slot 62 in turn moving belt 12 to and from stop surface 60. With roller bar 19 in the most forward position adjacent end 66 of slot 62, belt 12 may be moved relative to the roller bar for proper adjustment whereas with the roller bar in the rearward position near end 67, the roller bar forces the belt sharply against stop surface 60 thereby preventing relative motion of the belt relative to the roller bar. Stop surface 60 extends parallel to roller bar 19. Side slot 64 forms an enlarged portion of the main slot and provides a lock seat to releaseably hold and receive the opposite end portions of bar 19. Side slot 64 is positioned relative to stop surface 60 so that roller bar 19 when in slot 64 will force the belt against the stop surface preventing relative motion between the belt and roller bar.

Figure 5:
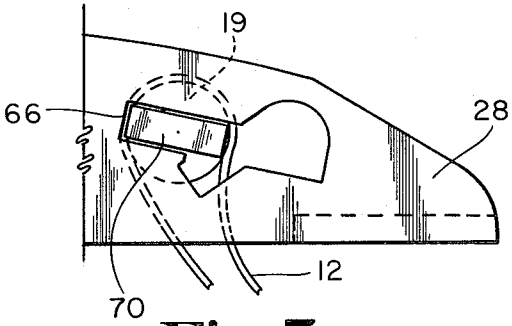
FIG. 5 is a fragmentary side view of the rear portion of the buckle frame with the roller bar shown in the unlocked position.
Figure 6:
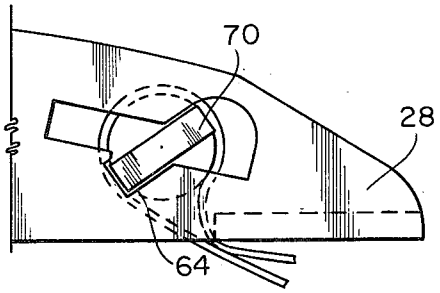
FIG. 6 is the same view as FIG. 5 only showing the roller bar in the locked position.

FIG. 5 is a schematic representation of the rear portion of the frame showing one of the flattened end portions 70 of roller bar 19 located in the forward position against end 66 of the main slot thereby allowing relative motion or adjustment of belt 12 relative to the roller bar. FIG. 6 is the same view as FIG. 5 only showing the flattened end portion 70 of roller bar 19 rotated sufficiently so as to extend into side slot 64 forcing the belt against the stop surface and preventing relative motion between the belt and roller bar. The roller bar is in the unlocked position in condition in FIG. 5 and is slidable between the opposite ends of main slot 62 whereas the roller bar is shown in the locked condition in FIG. 6 when the opposite end portions of the bar are positioned atop the seats or bottom end 71 (FIG. 4) of side slot 64.

The opposite flattened end portions 70 of the roller bar are sized so that the widths of the opposite end portions are slightly less than the width of slot 62 requiring the roller bar to be rotated in a counterclockwise direction when moving the bar from the position of FIG. 5 to the position of FIG. 6. Likewise, the roller bar must be rotated in a clockwise direction when moving from the locked position of FIG. 6 to the unlocked position of FIG. 5. Both opposite end portions of the roller bar are rib-configured with equal fixed lengths and equal fixed widths. The top end 72 of side slot 64 is radiused to allow the opposite end portions of the roller bar to be pivoted when moving into or out of the side slot. Further, the upward side edge 73 of side slot 64 leading into radiused end 72 is parallel to the bottommost edge 74 of the side slot providing a pair of stop surfaces contactable against the rib-configured end portion of roller bar 19.

Figure 7:
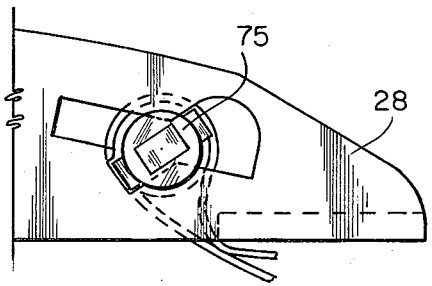
FIG. 7 is the same view as FIG. 6 only showing an optional design of the roller bar.

An optional feature of the roller bar is the attachment of a button 75 to one of the ends of the roller bar with the button being located outwardly of the frame side walls. Button 75 (FIG. 7) allows the user to conveniently rotate the roller bar from the position of FIG. 5 to the position shown in FIG. 6 and back. It is to be understood that button 75 is not necessary, however, to the operation of the device since the user may rotate the roller bar by grasping the roller bar and rotating the bar.

Side slot 64 opens into main slot 62 at a location between the opposite ends 66 and 67 of slot 62. The width or span of slot 64 extending in the direction of arrow 63 is greater than the width of end portion 70 of the roller bar but less than the length of the end portion 70 requiring the bar to be rotated from the unlocked position in FIG. 5 to the locked position of FIG. 6 prior to positioning the end portions of the roller bar into the side slots.

Figure 2:
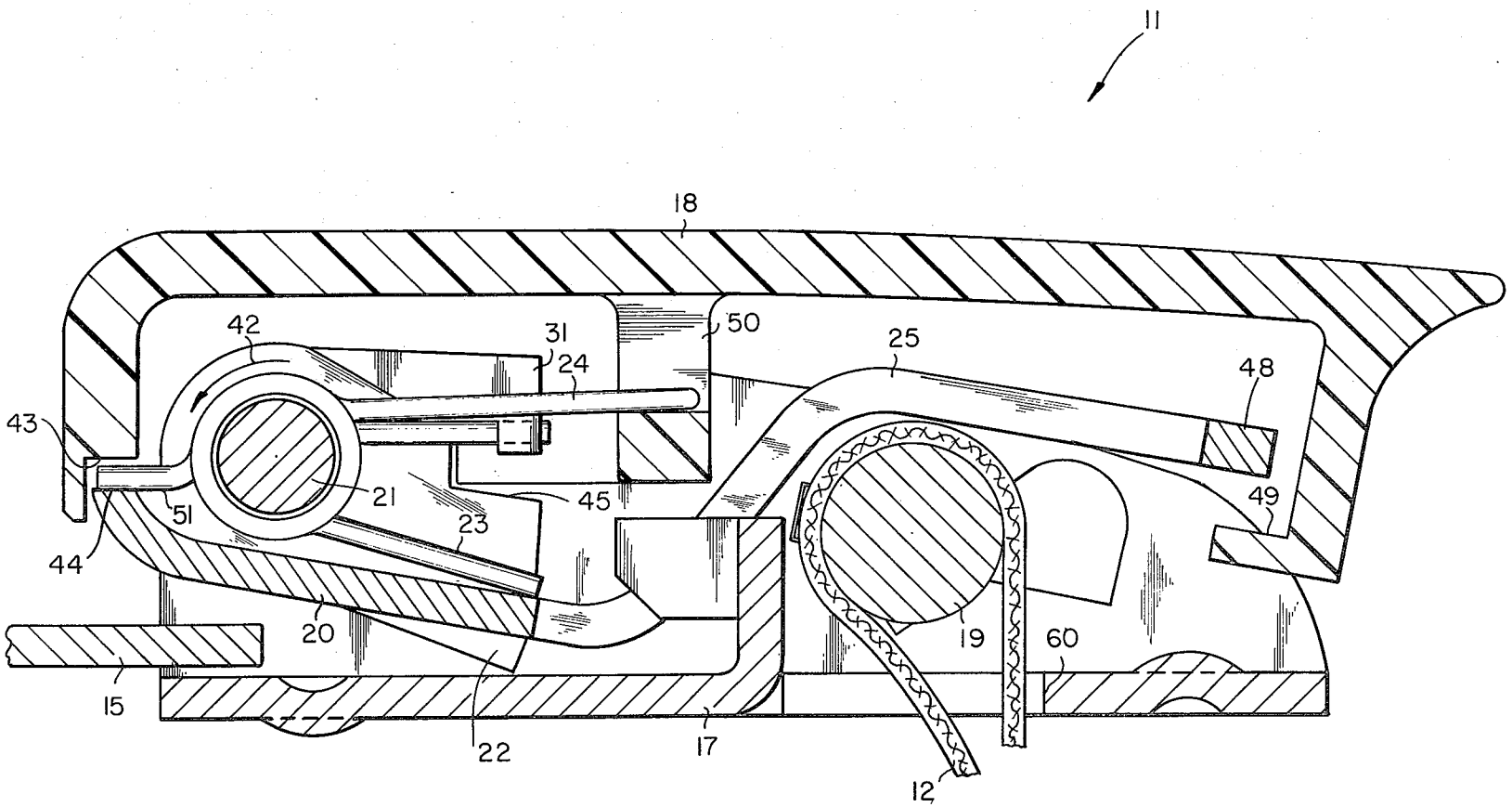
FIG. 2 is an enlarged cross-sectional view taken along the line 2—2 of FIG. 1 and viewed in the direction of the arrows.

Cover 18 and pawl 20 are shown in the locked position in FIG. 2. Cover 18 contacts the emergency release means 25 intermediate the locked position shown in FIG. 2 and the upraised or unlocked position of the pawl relative to the aperture tongue plate. Likewise, cover 18 contacts lip 44 of the pawl intermediate the downward or locked position and the upward or unlocked position of the pawl relative to the tongue plate.

Many variations are contemplated and included in the present invention. Further, although the drawings show the anti-creep roller bar as mounted to the buckle frame, it is to be understood that such anti-creep roller bar may be mounted to the tongue main frame and in turn attached to the belt attached to the tongue.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

The invention claimed is:

1. A seat belt device comprising:

a roller bar with opposite end portions;

a seat belt extending at least partially around said bar;

a frame with a pair of main slots receiving said opposite end portions mounting said bar to said frame, said frame having a seat belt stop extending parallel to said bar, each slot having opposite ends with said bar being movable therebetween, said ends being positioned to allow said bar to move said belt to and from said seat belt stop, said slots being enlarged at a location forming lock seats to releasably hold and receive said opposite end portions of said bar, said belt stop being positioned relative to said location to contact said belt limiting relative motion between said belt and said frame when said opposite end portions are in said lock seats and wherein said bar is in an unlocked condition when slidable between said opposite ends of said main slots and a locked condition when said opposite end portions are on said seats, said end portions are sized relative to said main slots to require rotation of said bar when changing back and forth from said locked condition to said unlocked conditions, said end portions of said bar are rib-configured with a fixed length and width, said frame includes side slots at said location opening into said main slots between said opposite ends with said side slots each with a span greater than said width but less than said length requiring said bar to be rotated from said unlocked condition prior to positioning said end portions into said side slots.

2. The seat belt device of claim 1 wherein said main slots are enlarged at one of said opposite ends allowing said end portions to be rotated prior to insertion into said side slots.

3. A seat belt buckle comprising:

a main frame attachable to a belt;

a cover pivotally mounted at one end of said frame and movable to and from a locked position and an unlocked position;

a pawl pivotally mounted to said frame at said one end and pivotable to and from said frame forming a space therebetween to receive an aperture tongue plate to be releasably secured;

spring means operable to normally urge said pawl toward said frame to secure said tongue but yieldable to allow movement of said pawl from said frame to release said tongue, said spring means also operable to urge said cover to said locked position but yieldable to allow said cover to pivot to said unlocked position, said cover contacting said pawl when said cover is pivoted to said unlocked position while pivoting said pawl away from said frame releasing said tongue, said pawl includes emergency release means operable to pivot said pawl away from said frame to release said tongue independent of said cover and wherein said cover contacts said emergency release means intermediate said locked position and said unlocked position of said cover to pivot said pawl.

4. The buckle of claim 3 wherein said emergency release means is spaced apart from said cover allowing an amount of free pivotal motion of said cover prior to said cover contacting said emergency release means.

5. The buckle of claim 4 wherein said emergency release means includes a member attached to said pawl extending rearwardly from said one end between said frame and said cover, said cover includes an extension extending between said member and frame and engageable with said member as said cover is pivoted toward said unlocked position.

6. The buckle of claim 5 wherein said cover contacts said emergency release means simultaneously when contacting said pawl at said one end.

7. The buckle of claim 6 wherein said pawl and said emergency release means are spaced from said cover allowing an amount of free pivotal motion of said cover prior to said cover contacting said pawl and said emergency release means.

8. A seat belt buckle comprising:

a main frame attachable to a belt;

a cover pivotally mounted at one end of said frame and movable to and from a locked position and an unlocked position;

a pawl pivotally mounted to said frame at said one end and pivotable to and from said frame forming a space therebetween to receive an aperture tongue plate to be releasably secured;

spring means operable to normally urge said pawl toward said frame to secure said tongue but yieldable to allow movement of said pawl from said frame to release said tongue, said spring means also operable to urge said cover to said locked position but yieldable to allow said cover to pivot to said unlocked position, said cover contacting said pawl when said cover is pivoted to said unlocked position while pivoting said pawl away from said frame releasing said tongue, said pawl includes emergency release means operable to pivot said pawl away from said frame to release said tongue independent of said cover;

a roller bar slidably mounted to said frame with said belt extending around said bar; and wherein:

said bar includes opposite end portions; and said frame includes a pair of main slots receiving said opposite end portions mounting said bar to said frame, said frame having a seat belt stop extending parallel to said bar, each slot having opposite ends with said bar being movable therebetween, said ends being positioned to allow said bar to move said belt to and from said seat belt stop, said slots being enlarged at a location forming lock seats to releasably hold and receive said opposite end portions of said bar, said belt stop being positioned relative to said location to contact said belt limiting relative motion between said belt and said frame when said opposite end portions are on said lock seats and wherein said bar is in an unlocked condition when slidable between said opposite ends of said main slots and a locked condition when said opposite end portions are on said seats, said end portions are sized relative to said main slots to require rotation of said bar when changing back and forth from said locked condition to said unlocked condition, said end portions of said bar are rib-configured with a fixed length and width, said frame includes side slots at said location opening into said main slots between said opposite ends with said side slots each with a span greater than said width but less than said length requiring said bar to be rotated from said unlocked condition prior to positioning said end portions into said side slots.

9. The seat belt device of claim 8 wherein said main slots are enlarged at one of said opposite ends allowing said end portions to be rotated prior to insertion into said side slots.

10. A seat belt device comprising:

a roller bar with opposite end portions;

a seat belt extending at least partially around said bar;

a frame with a pair of main slots receiving said opposite end portions mounting said bar to said frame, said frame having a seat belt stop extending parallel to said bar, each slot having opposite ends with said bar being movable therebetween, said ends being positioned to allow said bar to move said belt to and from said seat belt stop, said slots being enlarged at a location forming lock seats to releasably hold and receive said opposite end portions of said bar, said belt stop being positioned relative to said location to contact said belt limiting relative motion between said belt and said frame when said opposite end portions are in said lock seats and wherein said bar is in an unlocked condition when slidable between said opposite end portions of said main slots and a locked condition when said opposite end portions are on said seats, said end portions are sized relative to said main slots to require rotation of said bar when changing back and forth from said locked condition to said unlocked condition, said end portions of said bar are rib-configured with a fixed length and width, said frame includes side slots at said location opening into said main slots with said side slots each with a span greater than said width but less than said length requiring said bar to be rotated from said unlocked condition prior to positioning said end portions into said side slots.

11. The seat belt device of claim 10 wherein at least one of said end portions of said bar includes an external projection thereon allowing the user to rotate said roller bar.

12. A seat belt buckle comprising:

a main frame attachable to a belt;

a cover pivotally mounted to said frame and movable to and from a locked position and an unlocked position and including an end portion forming a grasping handle;

a pawl pivotally mounted to said frame and pivotable to and from said frame forming a space therebetween to receive an apertured tongue plate to be releasably secured;

spring means operable to normally urge said pawl towards said frame to secure said tongue but yieldable to allow movement of said pawl from said frame to release said tongue, said spring means also operable to urge said cover to said locked position but yieldable to allow said cover to pivot to said unlocked position, said cover operatively associated with said pawl when said cover is pivoted to said unlocked position to pivot said pawl away from said frame releasing said tongue, said pawl includes emergency release means operable to pivot said pawl away from said frame to release said tongue independent of said cover, said cover contacting said emergency release means intermediate said locked position and said unlocked position of said cover to pivot said pawl, said emergency release means includes a member attached to said pawl and extending rearwardly therefrom to said end portion of said cover forming a grasping lever which may be used to release said pawl in the absence of said cover.

13. The seat belt device of claim 12 and further comprising:

a seat belt;

a roller bar slidably mounted to said frame between a locked condition and an unlocked condition with said belt extending around said bar; and wherein:

said frame includes a pair of main slots and a pair of side slots;

said bar includes opposite end portions which are rib configured with a fixed length and width, said side slots open into said main slots with said slots each with a span greater than said width but less than said length requiring said bar to be rotated from said unlocked condition prior to positioning said end portions into said side slots.

* * * * *